US005657886A

United States Patent [19]

Tacchella

[11] Patent Number: 5,657,886

[45] Date of Patent: Aug. 19, 1997

[54] DECORATIVE ASSEMBLY INCLUDING A TRANSPARENT SLEEVE

[75] Inventor: William L. Tacchella, Sturgis, Mich.

[73] Assignee: Creative Resource, Inc., Sturgis, Mich.

[21] Appl. No.: 508,785

[22] Filed: Jul. 28, 1995

[51] Int. Cl.[6] ..... A47F 5/00

[52] U.S. Cl. ..... 211/105.1; 40/660; 211/123; 150/154; 4/610

[58] Field of Search ..... 232/17; 4/610; D6/610; 150/154; 211/105.1, 105.3, 123; 40/660, 661

[56] References Cited

U.S. PATENT DOCUMENTS

| | | | |
|---|---|---|---|
| 719,597 | 2/1903 | Lee | 40/660 |
| 1,318,041 | 10/1919 | Anthony | 40/660 |
| 1,446,628 | 2/1923 | Ridge . | |
| 3,083,494 | 4/1963 | Lindenbaum . | |
| 3,336,554 | 8/1967 | Hatton . | |
| 3,643,288 | 2/1972 | Olivari . | |
| 4,244,512 | 1/1981 | Wise | 232/17 |
| 4,454,671 | 6/1984 | Morgenstern | 40/660 |
| 4,782,554 | 11/1988 | Lawson . | |
| 4,798,016 | 1/1989 | Venditti et al. | 40/660 X |
| 4,865,105 | 9/1989 | Peters . | |
| 4,935,988 | 6/1990 | Ford et al. . | |
| 4,999,874 | 3/1991 | White . | |
| 5,039,049 | 8/1991 | Nieme . | |
| 5,122,401 | 6/1992 | Finkelstein . | |
| 5,154,218 | 10/1992 | Subecz . | |
| 5,259,520 | 11/1993 | Roggio et al. . | |
| 5,430,974 | 7/1995 | Hering | 40/660 X |

*Primary Examiner*—Robert W. Gibson, Jr.
*Attorney, Agent, or Firm*—Taylor & Associates, P.C.

[57] ABSTRACT

The invention is directed to a decorative assembly, including a pole, a decorative element wrapped about and covering at least a substantial portion of the pole, and a sleeve wrapped about each of the decorative element and the pole. The sleeve covers at least a substantial portion of each of the decorative element and the pole. The sleeve is constructed of a resilient and transparent material, and is configured to closely fit about the decorative element, whereby the decorative element is held closely adjacent to the pole by the sleeve and is visible through the sleeve.

7 Claims, 1 Drawing Sheet

DECORATIVE ASSEMBLY INCLUDING A TRANSPARENT SLEEVE

BACKGROUND OF THE INVENTION

1. Field of the Invention

The present invention relates to hardware for decorative treatments, and, more particularly, relates to hardware for decorative window treatments.

2. Description of the Related Art

A decorative assembly, such as a drapery rod assembly, typically includes a pole which is connected to a wall, and which carries a drapery. The drapery is slidably connected to the pole using a plurality of rings having an internal diameter which is larger than the external diameter of the pole. The pole typically is in the form of a wooden, plastic, or metal pole having a particular exterior appearance.

It is also known to cover a pole drapery rod assembly with a decorative element such as cloth, such that the drapery rod assembly can be better color coordinated with the drapery and/or wallpaper of the wall to which the drapery rod assembly is mounted. A problem with cloth covered poles is that the rings which slide thereon wear the cloth and thereby cause fraying, tearing, etc. A further problem is that the cloth may bunch up in front of or otherwise interfere with the use of the rings during a sliding operation of the rings on the pole. Examples of cloth covered poles may be found in U.S. Pat. Nos. 5,154,218 (Subecz); 3,643,288 (Olivari); 4,999,874 (White); and 5,259,520 (Roggio et al.).

It is also known to provide a longitudinally split cover for a rod which intimately engages the rod when placed thereabout. For example, U.S. Pat. No. 3,083,494 (Lindenbaum) discloses a cover which can be provided in a plurality of colors, and defines a decorative element disposed about a shower curtain rod. The cover is not disposed over a decorative element, but in fact is the decorative element. A problem with such a cover is that the cover is produced from cylindrical stock. Such cylindrical stock can be relatively easily spray painted to provide a plurality of colors, as known, but cannot be easily produced with intricate designs thereon. That is, in contrast with flat sheets which may have a printed pattern thereon using common printing techniques, a cylindrical part cannot be relatively easily produced with intricate patterns. Thus, color and design coordination using known covers for rods is quite limited.

What is needed in the art is a drapery rod assembly which allows color and design coordination provided by using a cloth or a fiber wrapped rod, without the disadvantages attendant therewith.

What is further needed in the art is a drapery rod assembly having a cover with a reduced friction surface, while at the same time providing nearly unlimited color and design coordination with the drapery and/or wall to which the drapery rod assembly is attached.

SUMMARY OF THE INVENTION

The present invention provides a drapery rod assembly including a transparent sleeve which covers a decorative element wrapped about a pole.

The invention comprises, in one form thereof, a decorative assembly, including a pole, a decorative element wrapped about and covering at least a substantial portion of the pole, and a sleeve wrapped about each of the decorative element and the pole. The sleeve covers at least a substantial portion of each of the decorative element and the pole. The sleeve is constructed of a resilient and transparent material, and is configured to closely fit about the decorative element, whereby the decorative element is held closely adjacent to the pole by the sleeve and is visible through the sleeve.

An advantage of the present invention is that decorative elements having an unlimited number of decorative patterns thereon can be wrapped about the pole, thereby providing an increased ability to color coordinate the drapery rod assembly with an associated drapery and/or wallpaper.

Another advantage is that the transparent sleeve prevents fraying, wearing, etc. of the decorative element by the rings which are slidable thereon.

Yet another advantage is that the sleeve provides a reduced friction surface which allows easier sliding operation of the rings on the pole.

A further advantage is that the decorative assembly of the present invention allows the decorative appearance to be easily changed from one season to another, without replacing the entire assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
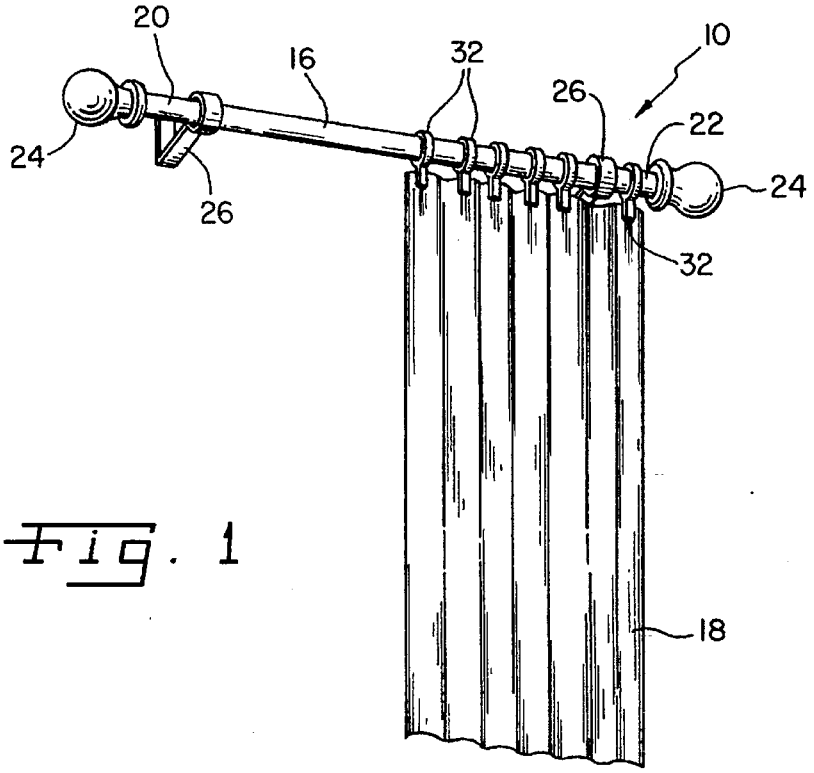
FIG. 1 is a perspective view of one embodiment of a drapery rod assembly of the present invention.
Figure 2:
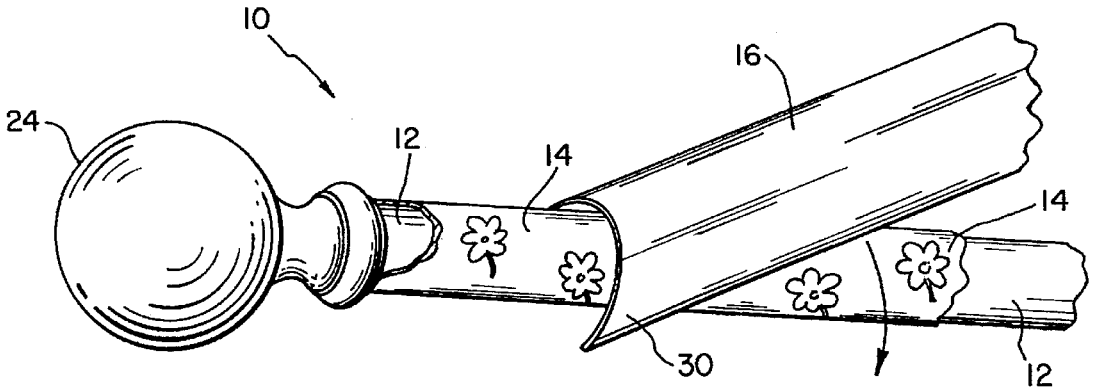
FIG. 2 is a fragmentary view of the drapery rod assembly shown in FIG. 1.

Referring now to the drawings, and more particularly to FIGS. 1 and 2, there is shown a decorative assembly 10 of the present invention which, in the embodiment shown, is in the form of a drapery rod assembly. However, it is also to be understood that decorative assembly 10 can be in the form of a shower curtain rod assembly, clothes hanger rod assembly, etc. Drapery rod assembly 10 includes a pole 12, decorative element 14 and sleeve 16 which together carry a drapery 18.

Figure 3:
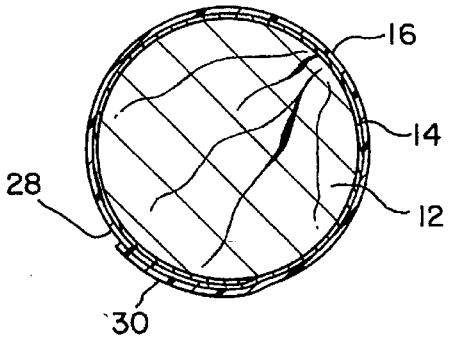
FIG. 3 is cross-sectional view of the drapery rod assembly shown in FIG. 1 and 2.

Elongated element or elongated pole 12 has a substantially circular cross section with a particular diameter (FIG. 3). However, it is to be understood that a pole 12 having a diameter other than that depicted in the drawings is also possible. Opposing ends 20, 22 are adapted for attachment to a pair of respective decorative knobs or finials 24. Pole 12 can be constructed of wood, paper, metal, plastic, or other suitable material. Pole 12 is attached to a wall using a pair of brackets 26.

As shown in the drawings, pole 12 has a substantially circular cross section, as indicated above. However, is also to be understood that pole 12 can be configured to have a fluted, spiral, or convolute shape as well.

Decorative element 14 is wrapped about and covers at least a substantially portion of pole 12. In the embodiment shown, decorative element 14 is in the form of wallpaper 14. However, decorative element 14 can likewise be in the form of a fabric, wall paper, wrapping paper, or other suitable material wrapped about pole 12, and having a pre-selected decorative appearance. Thus, with the present invention, it is possible to color coordinate drapery rod assembly 10 by placing a decorative element 14 having a desired decorative appearance about pole 12.

Sleeve 16 is wrapped about and covers at least a substantial portion of decorative element 14 and pole 12. More particularly, referring to FIG. 3, it is apparent that in the embodiment shown sleeve 16 covers all of decorative element 14 and pole 12. Sleeve 16 is constructed of a resilient and transparent, plastic material which is configured to closely fit about decorative element 14 and pole 12. More particularly, sleeve 16 is constructed in the form of a longitudinally split tube having overlapped edges 28, 30. As shown in FIGS. 2 and 3, sleeve 16 can be spread apart and placed over decorative element 14 when in an installed position as shown in FIG. 3. Overlapped edges 28, 30 are then disposed immediately adjacent to each other, whereby decorative element 14 is held closely adjacent to pole 12. Moreover, because sleeve 16 is constructed of a transparent material, decorative element 14 is visible through sleeve 16.

In the embodiment shown, sleeve 16 includes overlapped edges 28, 30 which are disposed adjacent to and overlapped relative to each other during use. However, sleeve 16 may include edges which do not overlap each other, but rather merely cover a substantial portion of decorative element 14 and pole 12. In such event, edges 28, 30 of sleeve 16 extending substantially parallel to the longitudinal axis thereof are disposed at the back of pole 12 such that the edges are not visible during use.

To assemble drapery rod assembly 10, decorative element 14 is wrapped about pole 12. Thereafter, sleeve 16 is spread apart and wrapped about each of decorative element 14 and pole 12. Drapery 18 is attached to sleeve 16 by a plurality of rings 32. Drapery rod assembly 10 is attached to a wall (not shown) using brackets 26. Decorative finials 24 can be optionally attached to opposing ends 20, 22 of pole 12.

In use, decorative element 14 is visible through sleeve 16, and may have a decorative appearance providing a color coordinated scheme. Sleeve 16 further provides a friction reduced surface which allows an easy sliding movement of rings 32 thereon. Finally, sleeve 16 protects decorative element 14 from frictional wear caused by the sliding movement of rings 32 thereon.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A decorative assembly, comprising:

a pole;

a decorative element wrapped about and covering at least a substantial portion of said pole; and a sleeve wrapped about each of said decorative element and said pole, said sleeve covering at least a substantial portion of each of said decorative element and said pole, said sleeve being longitudinally split and having overlapped edges, said sleeve comprised of a resilient and transparent material and configured to closely fit about said decorative element, whereby said decorative element is held closely adjacent to said pole by said sleeve and is visible through said sleeve.

2. The decorative assembly of claim 1, wherein said pole has a substantially circular cross-section.

3. The decorative assembly of claim 1, wherein said sleeve is adapted to wrap about a pole having one of a plurality of diameters.

4. The decorative assembly of claim 1, wherein said sleeve is consists essentially of a transparent, plastic material.

5. The decorative assembly of claim 1, wherein said sleeve covers all of said decorative element and said pole.

6. The decorative assembly of claim 1, wherein said pole has opposing ends, and further comprising a pair of decorative finials attached at respective said pole ends.

7. A drapery rod assembly, comprising:

a pole;

a decorative element wrapped about and covering at least a substantial portion of said pole; and a sleeve wrapped about each of said decorative element and said pole, said sleeve covering at least a substantial portion of each of said decorative element and said pole, said sleeve comprised of a resilient and transparent material and configured to closely fit about said decorative element, whereby said decorative element is held closely adjacent to said pole by said sleeve and is visible through said sleeve.

* * * * *